US005997328A

United States Patent [19]

Kodama et al.

[11] Patent Number: 5,997,328

[45] **Date of Patent: *Dec. 7, 1999**

[54] CONNECTOR STRUCTURE CONNECTOR CASING STRUCTURE AND CONNECTOR FITTING METHOD

[75] Inventors: Shinji Kodama; Isao Kameyama; Kiyohito Fukuda; Harunori Tashiro, all of Shizuoka, Japan

[73] Assignee: Yazaki Corporation, Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/757,511

[22] Filed: Nov. 27, 1996

[30] Foreign Application Priority Data

Nov. 28, 1995 [JP] Japan ..... 7-309055

[51] Int. Cl.[6] ..... H01R 13/64

[52] U.S. Cl. ..... 439/247

[58] Field of Search ..... 439/247, 248, 439/252

[56] References Cited

U.S. PATENT DOCUMENTS

| | | | |
|---|---|---|---|
| 2,954,543 | 9/1960 | Rayer et al. | 439/248 |
| 3,488,623 | 1/1970 | Stephenson et al. | 439/248 |
| 5,217,386 | 6/1993 | Ohsumi et al. | 439/364 |
| 5,383,790 | 1/1995 | Kerek et al. | 439/248 |
| 5,397,244 | 3/1995 | Generoli et al. | 439/248 |
| 5,552,959 | 9/1996 | Penniman et al. | 439/248 |

FOREIGN PATENT DOCUMENTS

| | | | |
|---|---|---|---|
| 64-27982 | 2/1989 | Japan . | |
| 1-142345 | 9/1989 | Japan . | |
| 675500 | 7/1979 | U.S.S.R. | 439/248 |

*Primary Examiner*—Gary F. Paumen
*Attorney, Agent, or Firm*—Morgan, Lewis & Bockius LLP

[57] ABSTRACT

A pair of connectors which are designed so that at least one of the connectors is made movable not only in the X and Y directions but also in the Z direction so that the pair of connectors are fitted to each other in normal positions smoothly and securely. A pair of connector casings containing a pair of connectors respectively, which are designed so that at least one of the connector casings is made movable not only in the X and Y directions but also in the Z direction so that the pair of connectors are fitted to each other in normal positions smoothly and securely. Preferably, an elastic or flexible member is provided in at least one of the connector and the connector casing so that the connector or the connector casing is made movable in the X, Y and Z directions. Alternatively, a holding member using an elastic or flexible member is interposed so that the connector or the connector casing is made movable in the X, Y and Z directions. More preferably, the pair of connector casings are connected and tightened to each other by means of a bolt so that the pair of connectors are fitted to each other smoothly and securely.

9 Claims, 9 Drawing Sheets

CONNECTOR STRUCTURE CONNECTOR CASING STRUCTURE AND CONNECTOR FITTING METHOD

BACKGROUND OF THE INVENTION

1. Field of the Invention

The present invention relates to a connector structure and a connector casing structure in which a fitting position just before the fitting of a connector disposed in a connector casing is corrected easily so that the fitting of the connector can be made easily and securely.

2. Description of the Related Art

A connector structure disclosed in Japanese Utility Model Unexamined Publication No. Sho. 64-27982 is shown in FIG. 16 as a conventional example of the connector structure related to the present invention.

Ring-shaped spring members 62 and flange portions 63 are provided in the outer circumference of a connector 61. The ring-shaped spring members 62 and the flange portions 63 are put into a groove 65 provided in an opening portion 64 so that the connector 61 is attached to the opening portion 64.

The position of the connector 61 is corrected in an X direction (which is a direction horizontally perpendicular to a fitting direction of the connector) and in a Y direction (which is a direction vertically perpendicular to the fitting direction of the connector) by the springing effect of the spring members 62 relative to a partner connector (not shown) to be fitted to the connector 61, so that the connector 61 and the partner connector are fitted to each other.

A connector casing structure disclosed in Japanese Utility Model Unexamined Publication No. Hei. 1-142345 is shown in FIG. 17 as a conventional example of the connector casing structure related to the present invention. Each of the connector structures used herein is the connector structure shown in FIG. 16.

A plurality of connectors 69 are fixed to a connector casing 66 attached to an instrument panel (not shown). Guide claws 68 are provided in the circumference of the connector casing 66.

A plurality of partner connectors 69' are fixed to a connector casing 67 attached to a body (not shown).

When the instrument panel is attached to the body, the guide claws 68 of the connector casing 66 guide the partner connector casing 67 to fit the connectors of the two connector casings to each other just before the fitting of the connectors.

The aforementioned technique however has the following problems:

(A) Because the connector 61 is made movable in the X and Y directions relative to the partner connector by the springing effect of the spring members 62 but is not made movable in a Z direction (which is the fitting direction of the connector), the fitting of the connectors of the two connector casings may be insufficient so that failure in contact between terminals in the two connector casings may occur;

(B) Because the connector casing 66 has the X- and Y-direction guiding functions provided by the guide claws 68 but the body of the connector casing 66 is not movable in any of the X, Y and Z directions, the connectors in the two connector casings may be insufficiently fitted to each other in normal positions even in the case where the two connector casings are guided to be fitted to each other by the guide claws 68 when there is relative displacement between the positions of attachment of the two connector casings; and so on.

SUMMARY OF THE INVENTION

To solve the problems, an object of the present invention is to provide a connector structure in which a connector is made movable not only in the X and Y directions but also in the Z direction relative to a partner connector so that the two connectors are fitted to each other smoothly and securely in normal positions.

Another object of the present invention is to provide a connector casing structure in which not only the X- and Y-direction guiding functions are provided but also the body of a connector casing is made movable in any of the X, Y and Z directions so that respective connectors fixed to two connector casings are fitted to each other smoothly and securely in normal positions even in the case where there is relative displacement between the positions of attachment of the two connector casings.

To accomplish the above object, according to a first aspect of the present invention, there is provided a connector structure comprising: a pair of connectors to be fitted to each other; and position adjusting means for holding at least one of the pair of connectors so as to be movable in an X direction which is horizontally perpendicular to a fitting direction of the pair of connectors, in a Y direction which is vertically perpendicular to the fitting direction of the pair of connectors and in a Z direction which is the fitting direction of the pair of connectors.

According to a second aspect of the present invention, there is provided a connector casing structure comprising: a pair of connector casings respectively containing connectors to be fitted to each other; and position adjusting means for holding at least one of the pair of connector casings so as to be movable in an X direction which is horizontally perpendicular to a fitting direction of the connectors, in a Y direction which is vertically perpendicular to the fitting direction of the connectors, and in a Z direction which is the fitting direction of the connectors.

According to a third aspect of the present invention, there is provided a connector fitting method comprising the steps of: disposing a pair of connectors in a pair of connector casings; and fitting the pair of connector casings to each other so that the pair of connectors are fitted to each other while adjusting a position of at least one of the pair of connectors in a Z direction which is a fitting direction of the pair of connectors after adjusting in an X direction which is horizontally perpendicular to the Z direction as well as a Y direction which is vertically perpendicular to the Z direction.

DETAILED DESCRIPTION OF THE PREFERRED EMBODIMENTS

A connector structure and a connector casing structure used in electric wiring for an automobile will be described below as an embodiment of the present invention.

Figure 1:
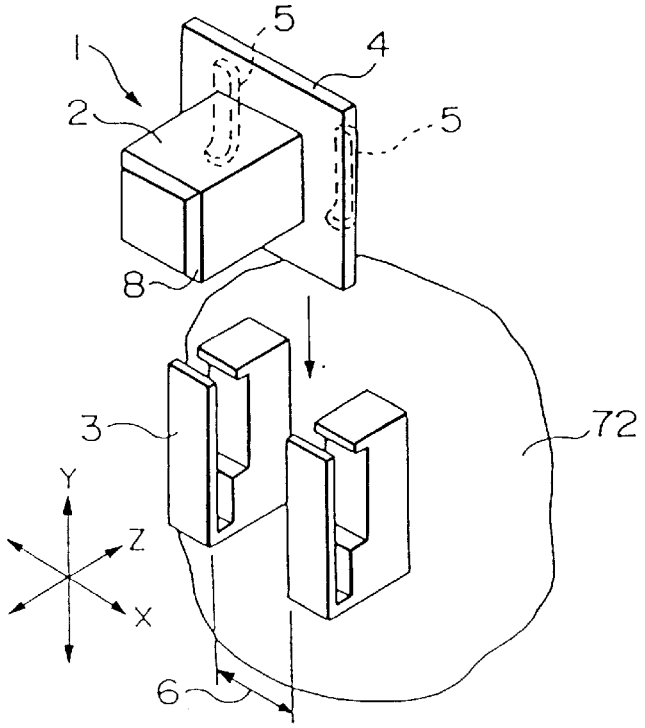
FIG. 1 is a view showing an embodiment of a connector structure according to the present invention.
Figure 2:
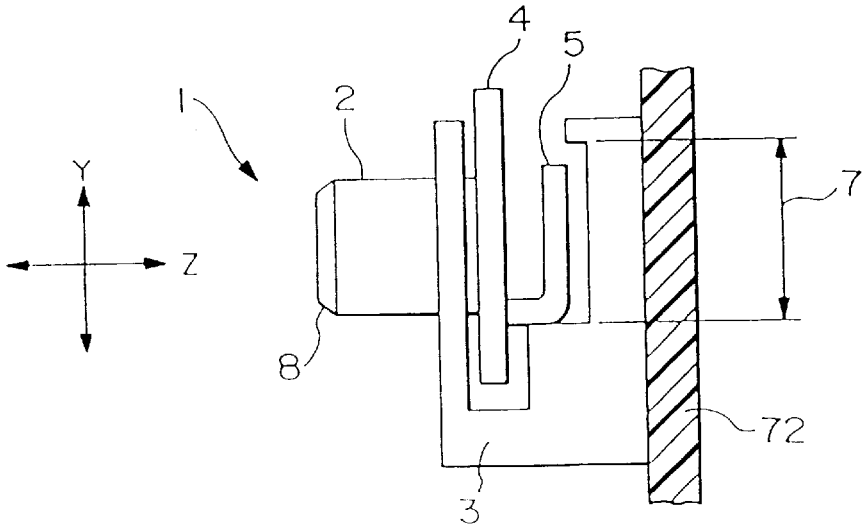
FIG. 2 is a view showing the embodiment of the connector structure according to the present invention.

Referring now to FIGS. 1 and 2, there is shown an embodiment of the connector structure according to the present invention.

FIG. 1 is a perspective view showing a movable connector 1 to be attached to an instrument panel 72.

The connector 1 comprises a connector housing 2, and receiving members 3. An insertion member 4 is provided on the back surface of the connector housing 2. A pair of flexible members 5 are provided on the back surface of the insertion member 4 and in positions corresponding to the receiving members 3 attached to the instrument panel 72. Further, the receiving members 3 are provided in pair and shaped so as to be suitable for holding the connector housing 2 in a state in which the insertion member 4 is inserted into the receiving members 3 from above. The receiving members 3 are attached to the instrument panel 72.

FIG. 2 is a sectional view showing the connector 1 attached to the instrument panel 72.

The connector housing 2 inserted from above is held by the receiving members 3 through the insertion member 4. The connector 1 is made movable in an X direction (which is a direction horizontally perpendicular to a fitting direction of the connector) by the margin of an arrangement distance 6 between the receiving members 3 with respect to the connector housing 2 as shown in FIG. 1, movable in a Y direction (which is a direction vertically perpendicular to the fitting direction of the connector) by the margin of a holding distance 7 between the receiving members 3 and movable in a Z direction (which is the fitting direction of the connector) by the flexibility of the flexible members 5.

With this structure, a taper 8 provided in the connector housing 2 is picked up by a partner connector when the connector 1 is to be fitted to the partner connector. As a result, the position of the connector housing 2 is adjusted so that the two connectors are fitted to each other in normal positions even in the case where there is some displacement between the relative positions of the two connectors.

Figure 3:
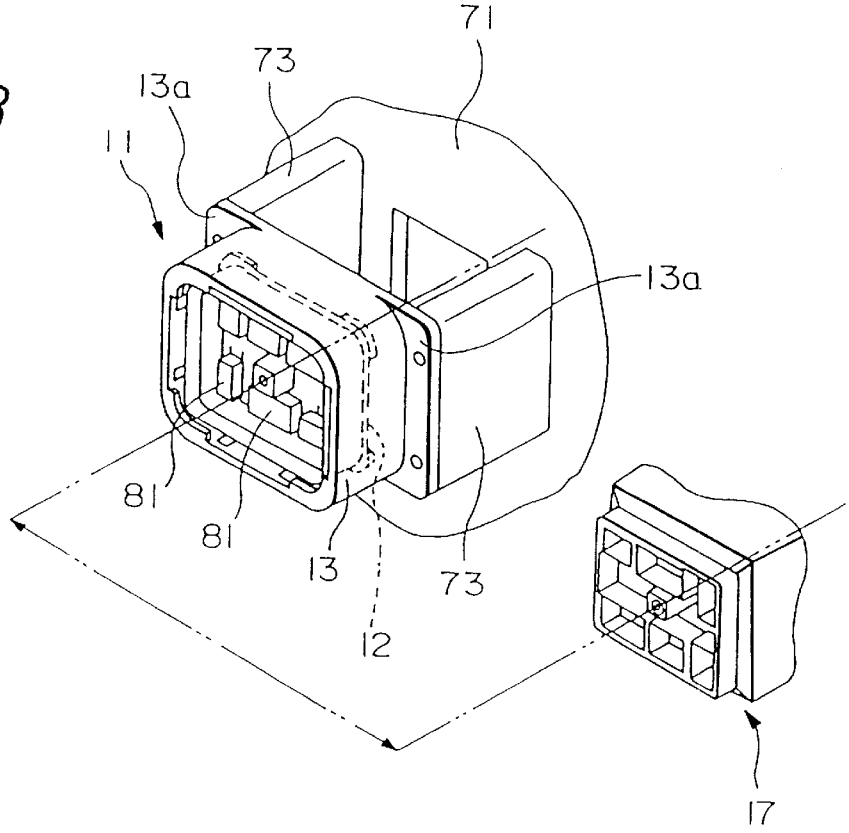
FIG. 3 is a view showing a first embodiment of a connector casing structure according to the present invention.
Figure 4:
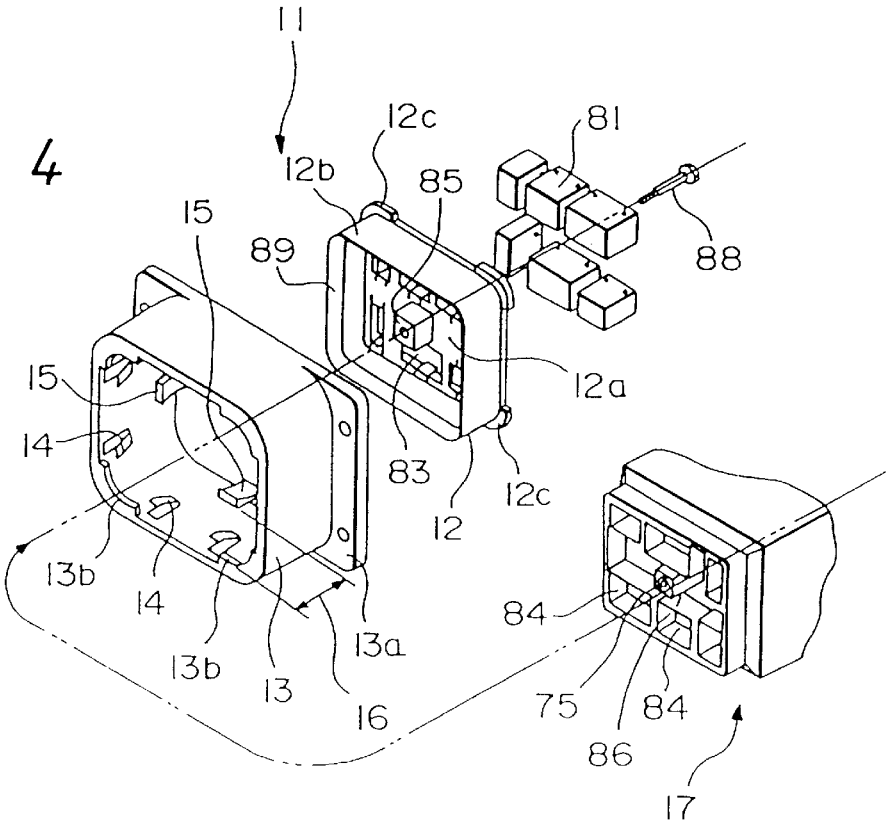
FIG. 4 is a view showing the first embodiment of the connector casing structure according to the present invention.
Figure 5:
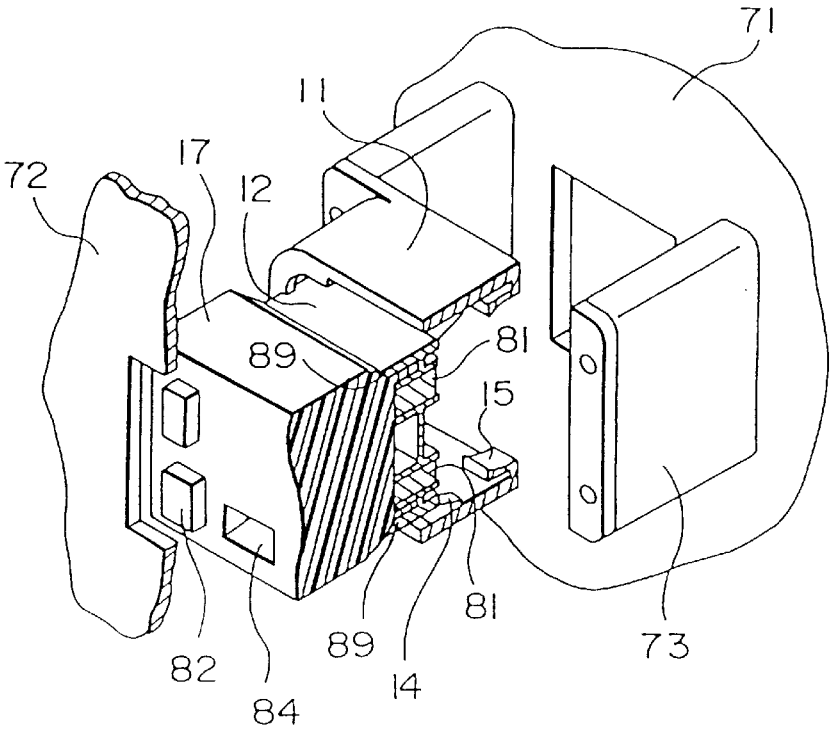
FIG. 5 is a view showing the first embodiment of the connector casing structure according to the present invention.

Next, a first embodiment of a connector casing structure according to the present invention is shown in FIGS. 3, 4 and 5.

FIG. 3 is a perspective view showing a connector casing 11 attached to a body 71 and a connector casing 17 attached to an instrument panel.

The connector casing 11 comprises a connector casing body 12, and a holding frame 13.

The connector casing 11 is attached to brackets 73 of the body 71 through flanges 13*a* of the holding frame 13.

Further, a plurality of connectors 81 are disposed in the connector casing body 12 housed in the holding frame 13.

The connector casing 17 is to be attached to the instrument panel.

FIG. 4 is an exploded perspective view of the connector casings 11 and 17.

A plurality of arrangement holes 83 in which the connectors 81 are to be arranged are provided in a bottom surface 12*a* of the connector casing body 12. Further, a taper 89 is applied to an inner edge portion of a frame portion 12*b* of the connector casing body 12. Further, stoppers 12*c* are provided in the bottom-side four corners of the outer circumference of the frame portion 12*b*. A seat portion 85 having a bolt hole is provided in the central portion of the connector casing body 12.

The holding frame 13 has such a frame shape that the connector casing body 12 is housed therein. Spring-like flexible members 14 and guide members 15 are provided in the inside of the holding frame 13. Further, stoppers 13*b* are provided in the four corners of the holding frame 13 on the side in which the connector casing body 12 is fitted to the partner connector casing body 17. Further, flanges 13*a* are provided on the body side of the outer circumference of the holding frame 13.

A bolt 88 is provided to make the fitting of the two connector sets 81 and 82 more securely.

The connector casing 17 has such a shape that the connector casing 17 can be fitted to the connector casing 11. A plurality of arrangement holes 84 in which connectors are to be arranged therein, are provided in the connector casing 17. Further, a seat portion 86 having a female screw 75 formed correspondingly to the bolt 88 is provided in the central portion of the connector casing 17.

FIG. 5 is a perspective view showing a state in which the connector casings 11 and 17 are being fitted to each other.

A method of fitting connectors will be described below.

(A) The connectors 82 are disposed in the arrangement holes 84 of the connector casing 17 and the connector casing 17 is attached to the instrument panel 72.

(B) The holding frame 13 is attached to the brackets 73 of the body 71.

(C) The connectors 81 are disposed in the arrangement holes 83 of the connector casing body 12 and the connector casing body 12 is inserted in the holding frame 13 from above the brackets 73. In this state, the connector casing body 12 is movable in the X and Y directions while held by the flexible members 14. Further, the connector casing body 12 is movable in the Z direction by the distance 16 between the stoppers 13*b* and the guide members 15 as shown in FIG. 4.

(D) The instrument panel 72 is attached to the body 71. In this occasion, the taper 89 of the connector casing 11 picks up the connector casing 17, so that the position of the connector casing body 12 is adjusted to eliminate displacement in the X and Y directions relative to the position of the connector casing 17 to thereby fit the connector sets 81 and 82 to each other. In this occasion, the connector sets 81 and 82 may be fitted to each other insufficiently in the Z direction.

(E) The bolt 88 shown in FIG. 4 is inserted in the female screw 75 of the connector casing 17 through the connector casing body 12 so that the connector casing body 12 and the connector casing 17 are connected and tightened to each other. By this measure, the Z-direction position is adjusted so that the connector sets are fitted to each other securely.

Figure 6:
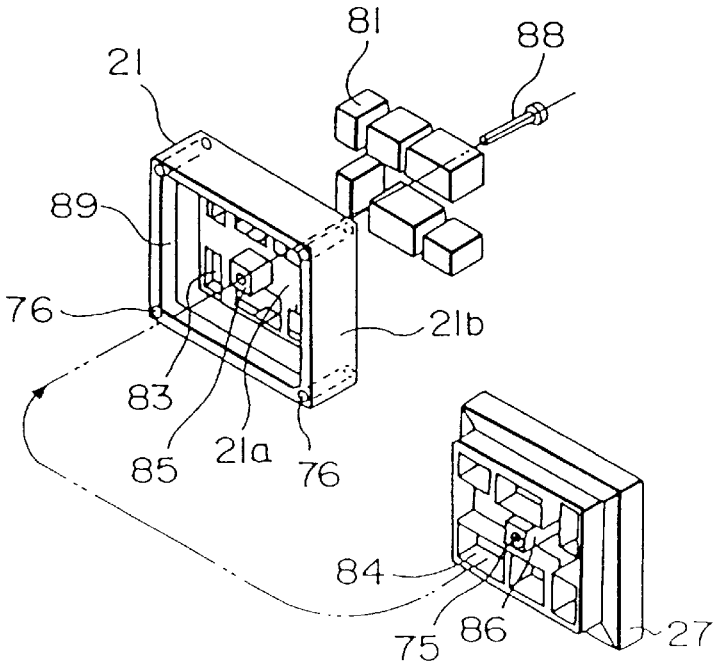
FIG. 6 is a view showing a second embodiment of the connector casing structure according to the present invention.
Figure 7:
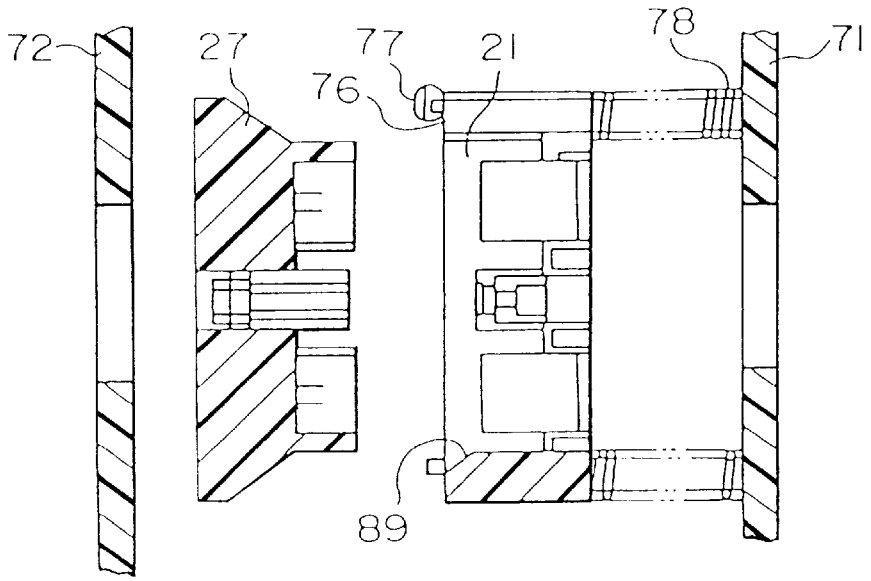
FIG. 7 is a view showing the second embodiment of the connector casing structure according to the present invention.

A second embodiment of the connector casing structure according to the present invention is shown in FIGS. 6 and 7.

FIG. 6 is an exploded perspective view showing a body-side connector casing 21 and an instrument-panel-side connector casing 27.

A plurality of arrangement holes 83 in which connectors 81 are to be arranged, are provided in a bottom surface 21*a* of the connector casing 21. Further, a taper 89 is applied to the inner edge portion of a frame portion 21*b* of the connector casing 21. Further, bolt holes 76 are provided in the four corners of the frame portion 21*b*. A seat portion 85 having a bolt hole is provided in the central portion of the connector casing body 21.

A bolt 88 is provided to make the fitting of the two connector sets more securely.

The connector casing 27 has such a shape that the connector casing 27 is fitted to the connector casing 21. A plurality of arrangement holes 84 in which connectors are to be arranged, are provided in the connector casing 27. Further, a seat portion 86 having a female screw 75 formed correspondingly to the bolt 88 is provided in the center of the connector casing 27.

FIG. 7 is a sectional view of the connector casing 21 attached to the body 71 and the connector casing 27 attached to the instrument panel 72.

The connector casing 21 is attached to the body 71 by bolts 77 inserted into the bolt holes 76 formed in the four corners of the connector casing 21. Further, springs 78 are wound on the portions of the bolts 77 respectively so as to be disposed between the connector casing 21 and the body 71.

A method of fitting the two connector sets will be described below.

(A) The connectors are disposed in the arrangement holes 84 of the connector casing 27 and the connector casing 27 is attached to the instrument panel 72.

(B) The connectors 81 are disposed in the arrangement holes 83 of the connector casing 21, and the bolts 77 wound with the springs 78 are inserted into the bolt holes 76 in the four corners of the connector casing 21 and attached to the body 71 through nuts. In this state, the connector casing 21 is made movable in the X and Y directions by the margin of the diameter of each of the bolt holes 76 while held by the bolts 77. Further, the connector casing 21 is made movable in the Z direction in a range of expansion/contraction of the springs 78 by the springs 78.

(C) The instrument panel 72 is attached to the body 71. In this occasion, the taper 89 of the connector casing 21 picks up the connector casing 27, so that the position of the connector casing 21 is adjusted to eliminate displacement in the X and Y directions relative to the position of the connector casing 27 to thereby fit the connector sets 81 and 82 to each other. In this occasion, the connector sets 81 and 82 may be fitted to each other insufficiently in the Z direction.

(D) The bolt 88 shown in FIG. 6 is inserted into the female screw 75 of the connector casing 27 through the connector casing 21 so that the connector casings 21 and 27 are connected and tightened to each other. By this measure, the Z-direction position is adjusted so that the two connector sets are fitted to each other securely.

Figure 8:
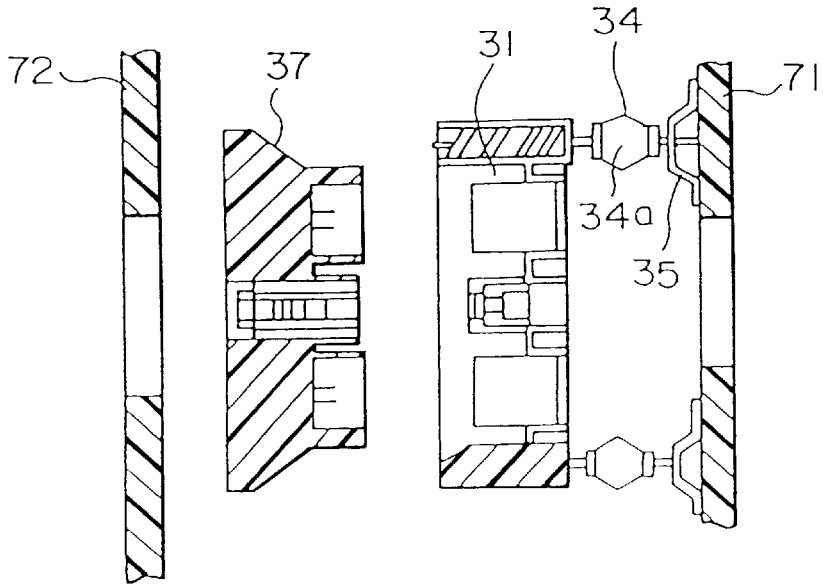
FIG. 8 is a view showing a third embodiment of the connector casing structure according to the present invention.
Figure 9:
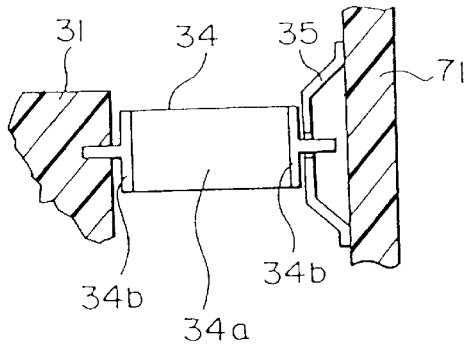
FIG. 9 is a view showing the third embodiment of the connector casing structure according to the present invention.

A third embodiment of the connector casing structure according to the present invention is shown in FIGS. 8 and 9.

FIG. 8 is a sectional view showing a connector casing 31 attached to the body 71 and a connector casing 37 attached to the instrument panel 72.

In this embodiment, the portions of the bolts 77 wound with the springs 78 used as the X-, Y- and Z-direction position adjusting means of the connector casing 21 in the second embodiment are replaced by flexible pins 34.

This embodiment is the same as the second embodiment in the other portions of the connector casing 31 than the flexible pins 34 and in the connector casing 37.

The connector casing 31 is attached, through the flexible pins 34, to receiving fittings 35 attached to the body 71.

In this state, the connector casing 31 is made movable in the X, Y and Z directions by elastic members 34*a* of the flexible pins 34.

FIG. 9 is a detailed view showing one of the flexible pins 34.

Each of the flexible pins 34 comprises an elastic member 34*a*, and support portions 34*b* disposed on opposite sides of the elastic member 34*a*. The elastic member 34*a* is formed from rubber so as to be able to expand/contract in the X, Y and Z directions.

Figure 10:
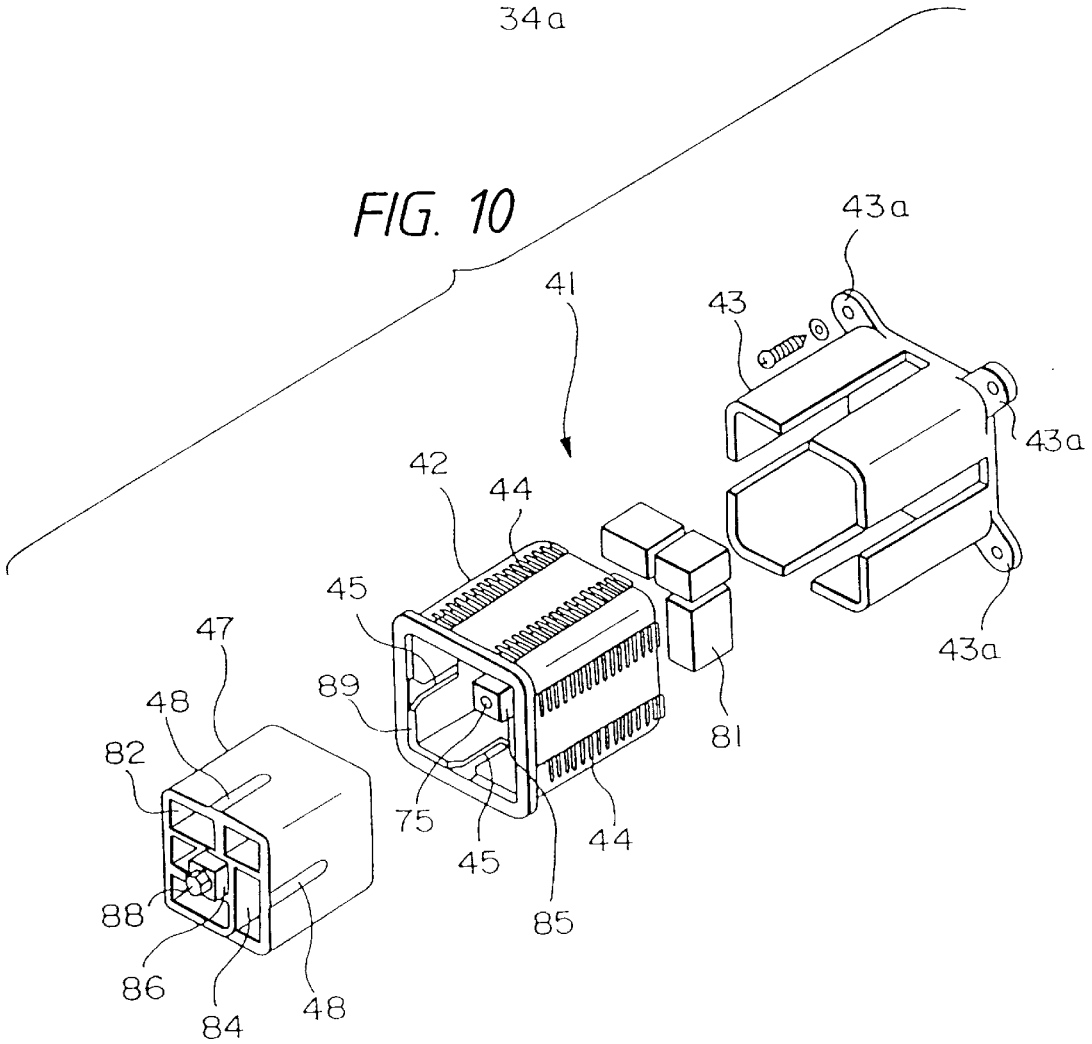
FIG. 10 is a view showing a fourth embodiment of the connector casing structure according to the present invention.
Figure 11:
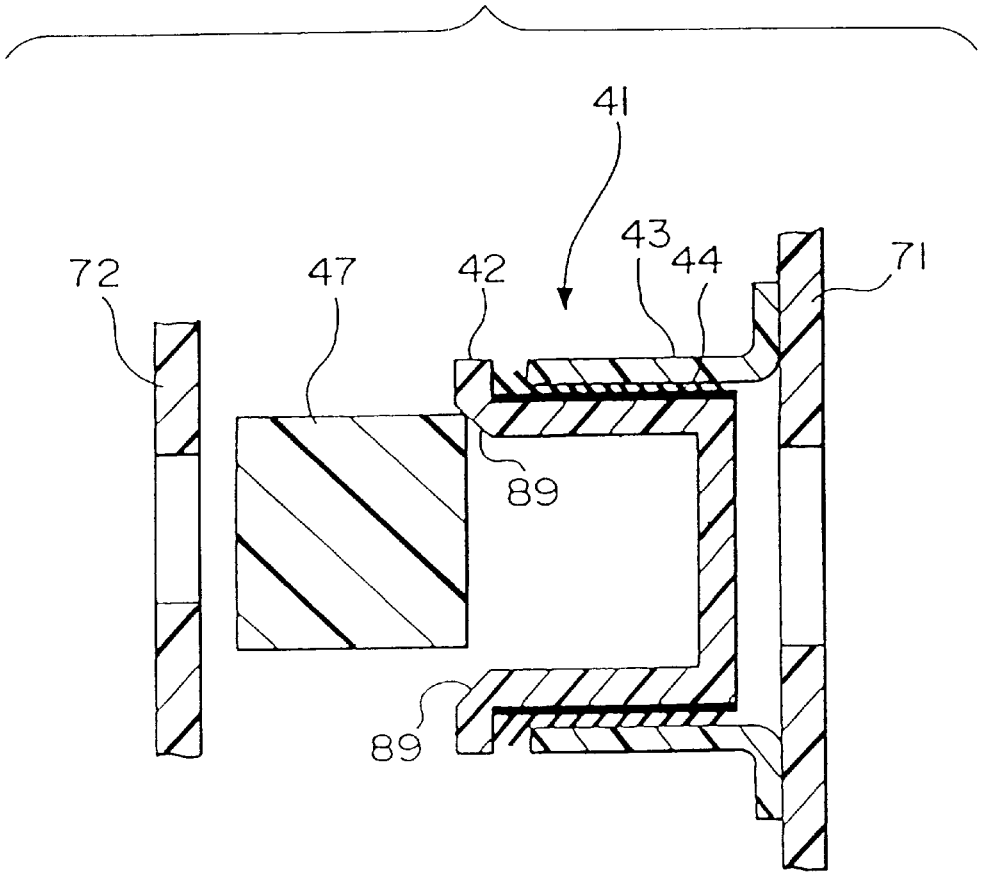
FIG. 11 is a view showing the fourth embodiment of the connector casing structure according to the present invention.
Figure 12:
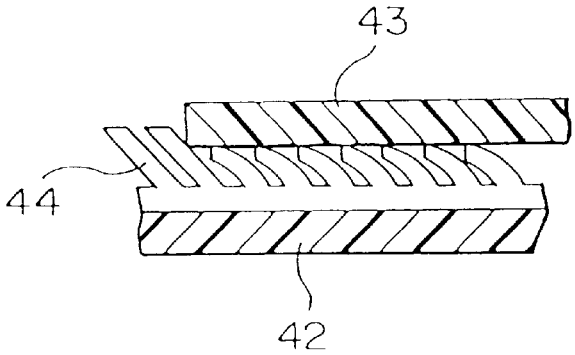
FIG. 12 is a view showing the fourth embodiment of the connector casing structure according to the present invention.

A fourth embodiment of the connector casing structure according to the present invention is shown in FIGS. 10, 11 and 12.

FIG. 10 is an exploded perspective view showing a body-side connector casing 41 and an instrument-panel-side connector casing 47.

The connector casing 41 comprises a connector casing body 42, and a holding frame 43.

The connector casing 41 is to be attached to the body through flanges 43*a* of the holding frame 43.

A plurality of arrangement holes (not shown) in which connectors 81 are to be arranged are provided in the bottom surface of the connector casing body 42. Belt-like flexible members 44 each formed from a plurality of folds are provided on the outer circumference of the connector casing body 42. A taper 89 is applied to the inner edge portion of the connector casing body 42. Guide grooves 45 are provided in the inside of the connector casing body 42. A seat portion 85 having a female screw 75 is provided in the central portion of the connector casing body 42.

The holding frame 43 is shaped so that the connector casing body 42 is housed therein. The flanges 43*a* are provided in the body-side four corners of the outer circumference of the holding frame 43.

Further, a plurality of arrangement holes 84 in which connectors are to be arranged are provided in the connector casing 47. A seat portion 86 having a bolt hole is provided in the central portion of the connector casing 47. Guide projections 48 are provided on the outer circumference of the connector casing 47.

A bolt 88 is provided to make the fitting of the two connector sets more securely.

FIG. 11 is a sectional view showing a state in which the connector casings 41 and 47 are being fitted to each other.

FIG. 12 is a sectional view showing one of the flexible members 44 in detail.

A method of fitting the connector casings will be described below.

(A) Connectors are disposed in the arrangement holes of the connector casing 47 and the connector casing 47 is attached to the instrument panel 72.

(B) The holding frame 43 is at tached to the body 71.

(C) Connectors are disposed in the arrangement holes of the connector casing body 42 and the connector casing body 42 is inserted into the holding frame 43. In this state, the connector casing body 42 is movable in the X, Y and Z directions while held by the flexible members 44.

Each of the flexible members 44 shown in FIG. 12 has such a shape as to be bent correspondingly to the insertion of the connector casing body 42. Further, the flexible members 44 are designed to resist against the force acting in a direction reverse to the direction of the insertion of the connector casing body 42.

(D) The instrument panel 72 is attached to the body 71. In this occasion, not only the taper 89 of the connector casing body 42 picks up the connector casing 47 but also the guide groves 45 of the connector casing body 42 shown in FIG. 10 pick up the guide projections 48 of the connector casing 47, so that the position of the connector casing body 42 is adjusted to eliminate displacement in the X and Y directions relative to the position of the connector casing 47 to thereby fit the connector sets to each other. In this occasion, the connector sets may be fitted to each other insufficiently in the Z direction.

(E) The bolt 88 shown in FIG. 10 is inserted into the female screw 75 of the connector casing body 42 through the connector casing 47 so that the connector casing body 42 and the connector casing 47 are connected and tightened to each other. In this occasion, the flexible members 44 resist the tightening force of the bolt but are overcome by the tightening force of the bolt, so that the Z-direction position of the connector casing body 42 is adjusted to thereby fit the connector sets to each other securely.

Figure 13:
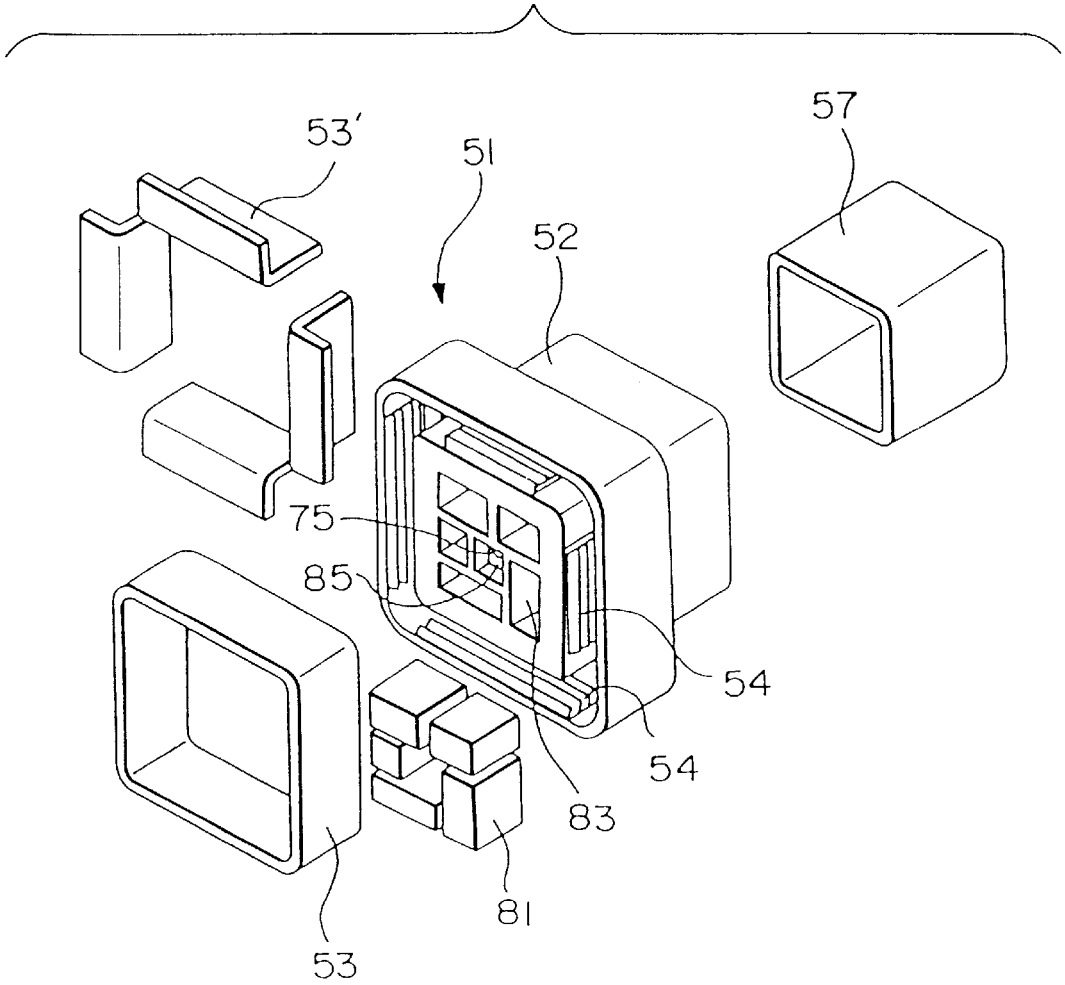
FIG. 13 is a view showing a fifth embodiment of the connector casing structure according to the present invention.
Figure 14:
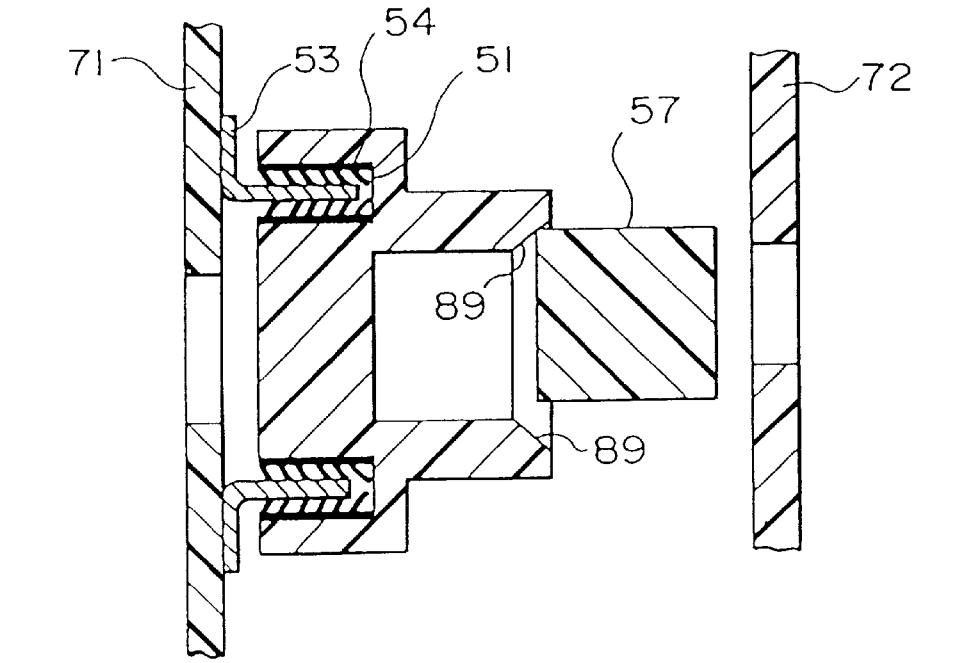
FIG. 14 is a view showing the fifth embodiment of the connector casing structure according to the present invention.
Figure 15:
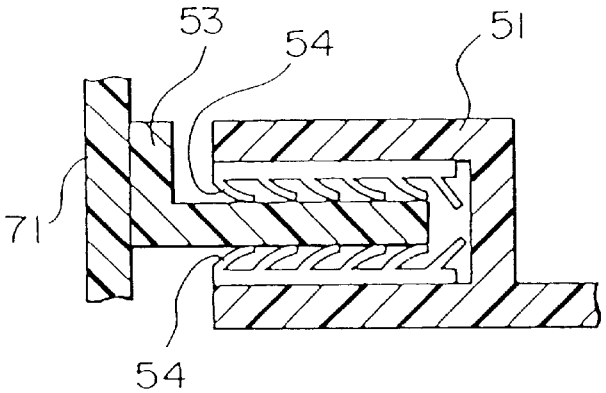
FIG. 15 is a view showing the fifth embodiment of the connector casing structure according to the present invention.
Figure 16:
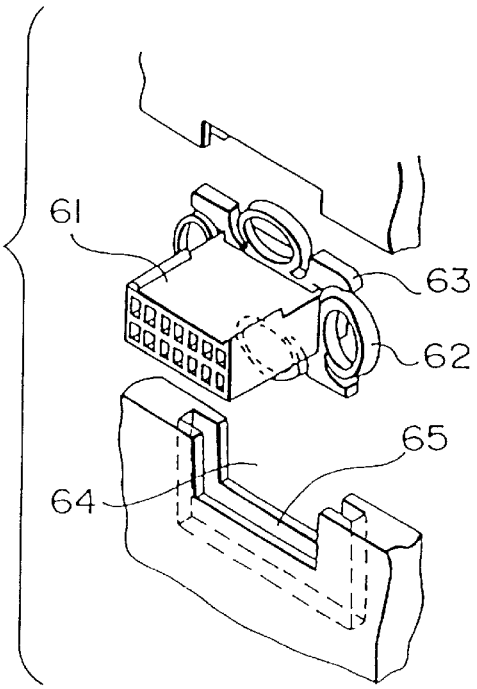
FIG. 16 PRIOR ART
FIG. 16 is a view for explaining a conventional connector structure.
Figure 17:
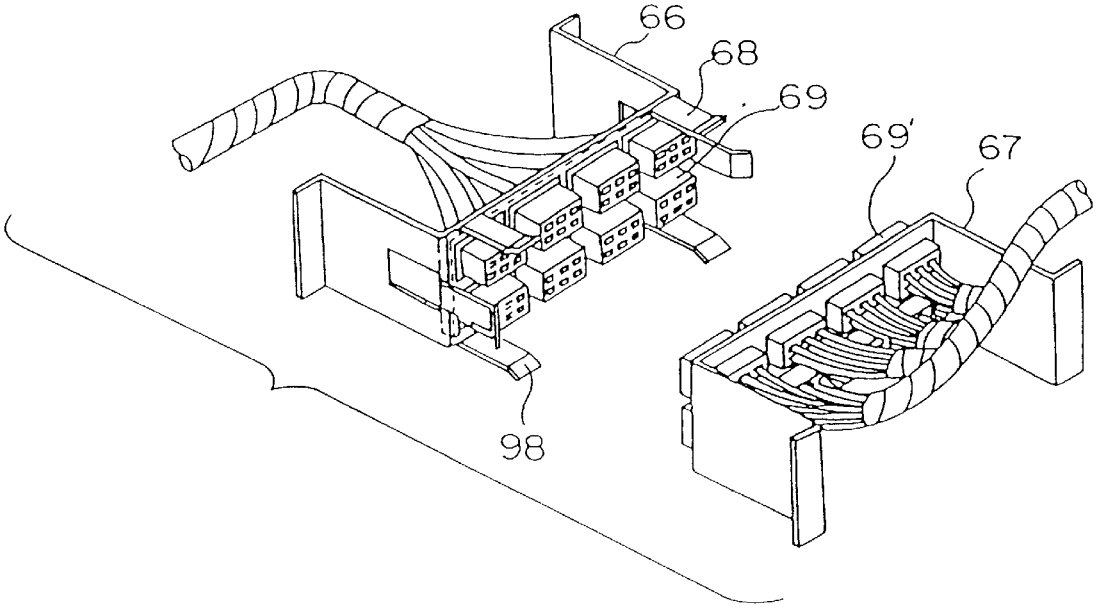
FIG. 17 PRIOR ART
FIG. 17 is a view for explaining a conventional connector casing structure.

A fifth embodiment of the connector casing structure according to the present invention is shown in FIGS. 13, 14 and 15.

In this embodiment, the same position adjusting means as in the fourth embodiment is used but the holding frame used as means for holding the connector casing body 42 is replaced by a holding bracket.

FIG. 13 is an exploded perspective view showing a body-side connector casing 51 and an instrument-panel-side connector casing 57.

The connector casing 51 comprises a connector casing body 52, and a holding bracket 53. The connector casing 51 is to be attached to the body through the holding bracket 53. A plurality of arrangement holes 83 in which connectors 81 are to be arranged are provided in the bottom surface of the connector casing body 52. Belt-like flexible members 54 each formed from a plurality of folds are provided in the inner circumference of a fitting portion in which the connector casing body 52 is fitted to the holding bracket 53. A seat portion 85 having a female screw 75 is provided in the central portion of the connector casing body 52.

The bracket 53 has a frame-like shape and is to be attached to the body. The bracket 53 may be replaced by brackets 53'.

The connector casing 57 is to be attached to the instrument panel. Further, a plurality of arrangement holes in which connectors are to be arranged are provided in the connector casing 57. A seat portion (not shown) having a bolt hole (not shown) is provided in the central portion of the connector casing 57.

FIG. 14 is a sectional view showing a state in which the connector casing 51 is being fitted to the connector casing 57.

FIG. 15 is a sectional view showing one of the flexible members 54 in detail.

The flexible members 54 are the same as the flexible members 44 used in the fourth embodiment.

A method of fitting the connectors is also the same as in the fourth embodiment.

There is no hindrance in the case where the body-side connector casing and the instrument-panel-side connector casing shown in the embodiments (from the first embodiment to the fifth embodiment) may be used as an instrument-panel-side connector casing and a body-side connector casing respectively.

Incidentally, it is a matter of course that the present invention is not limited to application to the body and instrument panel of an automobile and that the connector structure and the connector casing structure according to the present invention can be used as a connector structure and a connector casing structure for various electric wirings. In addition, the present invention, as to the shape, structure and material of each member, is not limited to the specific embodiments shown in the drawings.

The following effects are obtained by using the present invention.

(A) A connector is made movable not only in the X and Y directions but also in the Z direction relative to a partner connector, so that the two connectors are fitted to each other in normal positions smoothly and securely even in the case where there is some relative displacement between the positions of attachment of the two connectors.

(B) Not only a connector casing has X- and Y-direction guiding functions but also the connector casing is made movable in any of the X, Y and Z directions, so that not only the positions of connector sets fixed to the two connector casings respectively are adjusted to normal positions even in the case where there is some relative displacement in the X and Y directions between the positions of attachment of the two connector casings but also the two connector casings are fitted to each other smoothly and securely by connecting and tightening the two connector casings through a bolt even in the case where the connector sets are imperfectly fitted to each other in the Z direction.

What is claimed is:

1. A connector casing structure to be movably mounted on a surface in an automobile, the connector casing structure comprising:

a first connector casing having a through-hole;

a second connector casing to be fitted to a front side of the first connector casing;

a shaft disposed through the through-hole of the first connector casing, a first portion of the shaft extending from a rear side of the first connector casing such that a first end of the shaft is fixed to the mounting surface and a second portion of the shaft protruding from the front side of the first connector casing having a second end of the shaft with a head thereon; and a spring wound around the portion of the shaft extending from the rear side of the first connector casing, wherein the first connector casing is slidable on the shaft in a fitting direction of the first and second connector casings, wherein the spring biases the first connector casing toward a biased position which is towards the second connector casing such that the first connector casing abuts the head of the shaft when the first connector casing is disposed at the biased position, and wherein an inner diameter of the through-hole is greater than an outer diameter of the shaft to allow movement of the first connector casing laterally with respect to the fitting direction even when the first connector casing is disposed in the biased position.

2. The connector casing structure according to claim 1, wherein said first and second connector casings are connected to each other by a bolt.

3. The connector casing structure according to claim 1, wherein at least one of the first and second connector casings has a tapered portion.

4. The connector casing structure according to claim 1, wherein one of the first and second connector casings is fixed to a fixed member and the other is fixed to a fixing member so that the first and second connector casings are disposed so as to be opposite to each other in a non-contact state when the fixed member is fixed to the fixing member.

5. The connector casing structure according to claim 1, wherein one of the first and second connector casings is fixed to an instrument panel of an automobile and the other is fixed to a body of the automobile.

6. The connector casing structure according to claim 1, wherein the inner diameter of the through-hole is substantially constant along the length of the through-hole.

7. The connector casing structure according to claim 1, wherein the front side of the first connector casing defines a first opening for receiving the second connector casing and a second opening at one end of the through-hole, the first and second openings being substantially co-planar.

8. The connector casing structure according to claim 1, wherein the head of the shaft has a larger diameter than the through-hole.

9. The connector casing structure according to claim 1, wherein the first connector casing is slidable on the shaft such that the fitting direction of the first connector casing remains substantially parallel to the shaft.

* * * * *